United States Patent [19]

Lucas Huerta

[11] Patent Number: 4,653,548

[45] Date of Patent: Mar. 31, 1987

[54] TOOL FOR TYING CROSSING ELEMENTS

[75] Inventor: Antonio Lucas Huerta, Elcano-Egües, Spain

[73] Assignee: Simes-Senco, S.A., Elcano-Egües, Spain

[21] Appl. No.: 758,573

[22] Filed: Jul. 24, 1985

Related U.S. Application Data

[62] Division of Ser. No. 510,453, Jul. 1, 1983, abandoned.

[30] Foreign Application Priority Data

Jul. 23, 1982 [ES] Spain ..... 514.261

[51] Int. Cl.[4] ..... B21F 15/04

[52] U.S. Cl. ..... 140/119; 140/57; 140/93 A

[58] Field of Search ..... 140/57, 115, 119, 122, 140/124, 93 A

[56] References Cited

U.S. PATENT DOCUMENTS

| | | | |
|---|---|---|---|
| 849,256 | 4/1907 | Moore | 140/53 |
| 951,454 | 3/1910 | Reichhelm | 140/54 |
| 1,209,434 | 12/1916 | Hayden | 140/93 A |
| 3,587,668 | 6/1971 | Ward | 140/119 |
| 3,949,944 | 4/1976 | Bent | 140/124 |
| 4,160,469 | 7/1979 | Joannic | 140/119 |
| 4,371,010 | 2/1983 | Hidassy | 140/93 A |

FOREIGN PATENT DOCUMENTS

| | | | |
|---|---|---|---|
| 2341405 | 9/1977 | France | 140/57 |
| 507517 | 6/1939 | United Kingdom | 140/93 D |
| 554050 | 4/1977 | U.S.S.R. | 140/57 |

*Primary Examiner*—Lowell A. Larson
*Attorney, Agent, or Firm*—Browdy and Neimark

[57] ABSTRACT

A process for tying metal reinforcement and/or mesh structures wherein U-shaped clips having bent and generally diverging arms are placed at the crossings of the rod to be tied together and engage twice on each of the rods of the crossing, the arm ends being closed by being twisted until a portion of the ends ruptures, the twisting being performed by a substantially longitudinal tool having at the front jaws which in the open state close on the clip ends, turn and twist the same and finally break the ends leaving them twisted, the jaws returning to the same initial position.

4 Claims, 19 Drawing Figures

TOOL FOR TYING CROSSING ELEMENTS

This application is a division of application Ser. No. 510,453, filed July 1, 1983, now abandoned.

Use of the process is aimed generally at providing a system for tying and strengthening crossing metal elements which contact one another at their crossing place in order to secure them appropriately.

The crossing angles of the elements may or may not be right-angles; also, one of the crossing elements may be other than straight, the zone which crosses the other element having a bend of e.g. 90°.

There are two prior art procedures for tying metal elements, for instance, in the preparation of metal reinforcements of use, of course, in the building industry. One of the known procedures is manual tying of the rounds used for the skeleton of the structure, such as rods, stirrups, strengthening rods etc., with the use of ordinary wire which the operator places manually at the crossing places, then twists the wire until they engage around the two elements. The operatives for this conventional system must of course be experts; the system also presents a number of problems such as operator fatigue, tying which is not very rational or uniform, since it is done manually and depends upon the efficiency of the operator as he proceeds in his work, with the final result of the lack of uniformity previously mentioned and relative rigidity of the tying and of the final position.

Another conventional procedure or system resides in securing the rounds by welding, although welding is officially forbidden in many countries since it alters the material of the weld zones and in the zones adjacent the weld zones. Also, the operatives are subjected to the welding gases and must be given medical checks at least twice a year, while the actual working position affects the cervical vertebrae. A final snag is the substantial wastage of material when the operator makes a mistake.

Of the known techniques, U.S. Pat. No. 3,169,559 of Loren F. Working JR., provides a wire tying tool which automatically twists the ends of a substantially U-shaped clip previously placed on two crossing members of a lattice work of reinforcing rods. The tying tool used is to some extent a stapler having a clip magazine extending through the voids of the lattice work, the tool placing the clip at the crossing places and twisting the free ends of the clips to apply pressure to the rods. This apparatus, although automatic, is of limited practical use for a number of reasons which restrict its use in the building industry.

First, since the tool has to extend through the gaps of a lattice work, the gaps must be large enough to allow the passage of the tool, in point of fact the tool head which performs the operation of twisting the clip ends. In the building industry, however, special structures are very common, such as in pillars or columns where stirrups are placed very close together, with insufficient space to operate the tool. Also, the gaps in lattice works may sometimes be too small for the tool to pass through them, so that there are limitations on the use of the tool.

Also, the U-clips of U.S. Pat. No. 3,169,559 are placed diagonally on the lattice work members, with the obvious result of an unstable structure due to poor contact between the clip and the lattice work members in each "knot".

As a final disadvantage, the known tying tool twists but does not sever the clip ends, with the result of lack of tying pressure, more particularly in vital structures of a building job. In contrast to this prior art the system of this specification provides a semiautomatic process combining specially shaped clips with a tool which twists the clip ends and severs them when the pressure on the lattice work members has reached a critical level.

It is an object of this invention to provide specially shaped clips which are placed at the crossing places of lattice work or similar rods or the like, the clips being other than monoplanar.

It is another object of the invention to provide a clip of use both for mesh structures and for metal reinforcing structures in general such as columns, beams, etc., in which one of the crossing members is an angular member, such as a stirrup, and which makes the shape and position of the rods independent of the tying of the clips and also makes such tying independent of the distance or gap between the various tying places or "knots".

Another object of the invention is to provide a clip which does not itself have to be clamped for its free ends to be twisted, severance of the ends of the twisted parts providing very strong securing of the rods.

Another object of the invention is to provide clips which bear "doubly" on each of the rods.

Another object of the invention is to provide a tool which takes up, twists and severs the clip ends.

The invention provides a process starting from preshaped clips disposed in groups in applicators or in strips without applicator, the applicators being manually operated and being disposed appropriately on the crossing places to be tied. The clips can if required, be combined on a strip of board or paper for manual use so that they do not interlock with one another. As a final alternative, the clips can present in completely separate form one from another.

The clips are placed appropriately at the crossing places to be tied, they are of the same shape for any particular case and are positioned identically relatively to one another. The clips have two projecting ends which of course project in the same general position as one another once the clips have been positioned; appropriate tool engages and rotates the clip ends relatively to one another until the twist produced against one of the elements to be tied overcomes the plastic deformation of the clips, such deformation turning into rupture, a portion of the projecting ends being severed and the connection between the crossing elements being strengthened.

In general terms, the clips according to the invention are U-shaped with arms of various shapes and inclinations relatively to the central portion of their central place zone; clip cross-section diameters vary between 0.80 and 2.5 mm if the cross-sections are circular; if required, the clip cross-section can be polygonal or elliptical uneven if, for instance, a helical wire is used. The hardness of the wire used for the clips can be between 35 and 50 kg/mm$^2$, depending on the particular kind of tying required. As a rule, an uncovererd wire having a tensile strength of some 46 kg/mm$^2$ is used. In connection with hardness of the material, the free end of the clips can be formed optionally with rebates or notches near their ends to ensure, if necessary, reliable severance of the clip end.

The clips are combined in appropriate groups by being placed one beside another and stuck together by an appropriate adhesive, for instance, of the kind used to stick the staples of a conventional stapler together, so that very little force is needed to separate the first clip from the remainder of the group. A group of this kind is placed inside an applicator or positioning device having an inner chamber which receives the group of clips and a simple form of feeder which forces the group towards the exit, and the grip or handle to enable the operators to position the device at the crossing place of the element to be tied. The first clip of the group is easily placed at the crossing place, so that the connection between the first clip and the remaining clips is readily broken, the base of the applicator being left partly free for the partial entry of one of the elements to be tied.

Once one of the clips - i.e., the first clip - has disengaged from the remainder, the disengaged clip is placed at a particular crossing place in conditions which will be described in greater detail hereinafter in connection with the specific shape of the clips and the position or shape of the crossing between the element to be tied.

The clips according to the invention have a special shape based on a substantially U-shaped wire whose arms are other than straight, being bent and diverging slightly from the clip base. The bend angle of the clip arms can vary to suit individual applications, as will be described hereinafter. Also, the clip ends may be formed with angular irregularities which help to retain the clip on the members to be tied before the clip ends are twisted.

A characteristic place will be described to start with; such place can be one of the places where a stirrup crosses a rod, for instance, in a column, the stirrup engaging around the rod through an angle of 90°, so that the stirrup is substantially a rectangle and engages the rods at its four inner vertices. In this characteristic situation the invention uses the U-clip with its arms bent at an angle, the clip base engaging the horizontal portion of the stirrup while the bent arms engage the rod, so that the same rests on the portions where the arms are bent. The arm ends are disposed on both sides of the vertical part of the stirrup.

In a previous assembly of rods and stirrups, all the ends of the arms of the clips of a row are positioned identically relatively to one another and with the same strength projecting, since the clips used are all identical. There is complete uniformity and all the tying places are prepared equally in order to be strengthened equally, a consideration which, as will be seen hereinafter, is very important.

The free ends of the clip arms are engaged by the jaws of an appropriate tool which turns the arm ends and twists them in contact with one another until they clamp the vertical part of the stirrup and the yield point of the wire is exceeded so that it ruptures, whereupon the clip arm ends break. The arm ends so rupture that between the rupture positions and the vertical part of the stirrup a twisted portion of wire consisting of portions of the clip arms remains. This twisted portion is in contact with the vertical part of the stirrup and presses thereagainst; because of the twisting, such pressure is transmitted to the central part or base of the clip which presses on the horizontal parts of the stirrups and on the bent parts of the clip arms which engage with the sides of the horizontal and vertical parts of the stirrup; consequently, the stirrup and the rod are given a permanent and non-releasable connection.

As previously stated, the clip arm zones near the clip arm ends can have portions reduced by notching, softening etc. to weaken the cross-section of the corresponding zones and serving, according to the type or hardness of the metal used, to facilitate the rupturing of the wire when it is twisted.

The general behaviour and operation is very simple and rapid. The operator picks up the clip applicator or positioner in one hand and the twisting tool in the other. At the start of a row of crossing places to be tied, the operator proceeds to place a clip on a crossing place with one hand and with the other hand he applies the twisting tool, proceeding consecutively from one crossing place to another until completing the tying of a particular set of system, the work proceeding very rapidly and without operator fatigue and in the certain knowledge that all the crossing places have been tied and strengthed regularly and uniformly since identical clips have been used for every operation and identical force has been used to twist the clip arm end.

To tie the places where the stirrups meet strengthening rods, such places being merely where both such elements cross, the clip is also in the general shape of a U but its arms are more curved than the previous case and the central or base zone of the clip engages the stirrup on one of its sides relatively to the strengthening rod while the curved zone of the arms bears on such rod, the arm ends being adapted to be twisted against the other portion of the stirrup.

The invention also covers elements which cross one another in the previous cases but at angles other than right-angles without any problems arising, the tying procedure being exactly the same as in the cases described.

As previously stated, the process covers consecutive performance of the two operations - i.e., positioning a clip and twisting its free ends, which latter are bound always to be situated in the same position at every crossing place. In this situation, the projecting parts of the clips once positioned are engaged by a tool having at the front a pair of jaws which when opened close on the projecting parts with pressure, turn the two projecting parts and twist them until they rupture, whereafter the jaws reopen and automatically return to their initial open position ready to receive the projecting parts of the next clip, without the operator's work varying.

The tool has means for opening and closing the front jaws, means for rotating the same when they are closed on the clip ends and means for returning the jaws to their initial position. All such means are received in a casing having elongated substantially cylindrical shape terminating in a head whose front exterior the jaws have access.

All the advantages, features and other aspects of the invention will become apparent from the description in combination with the accompanying drawings wherein.

Figure 1:
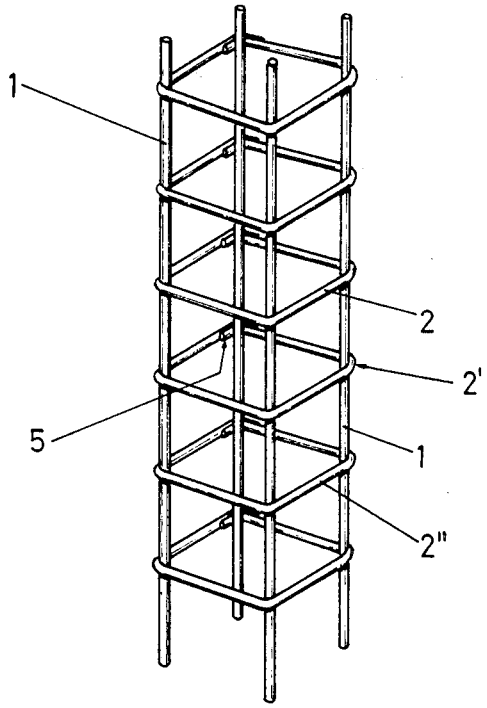
FIGS. 1–4 show various structures in which the invention is used.
Figure 2:
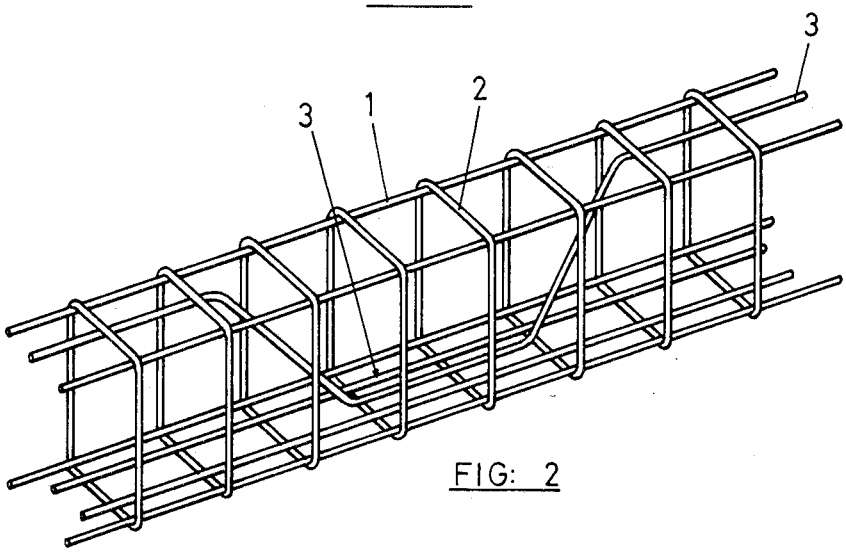
Figure 3:
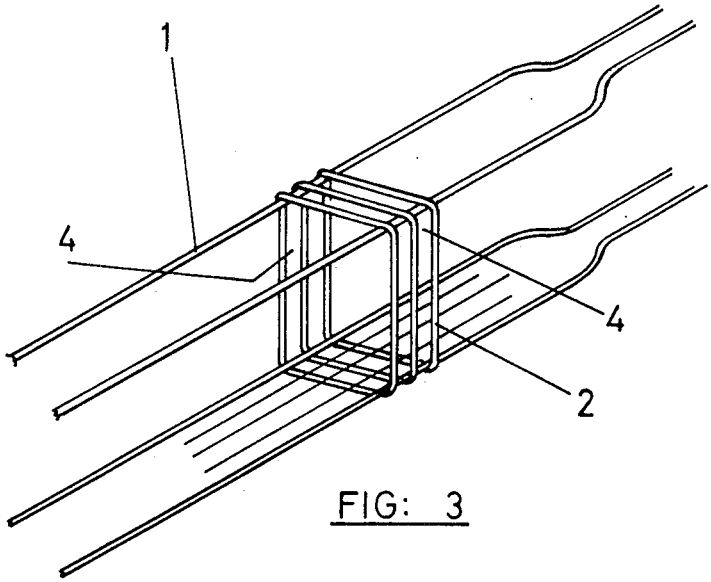

The drawings, more particularly FIGS. 1-5, show metal structures which are known in the building art, namely a column (FIG. 1), a beam or joist (FIG. 2), a special structure (FIG. 3), a mattress or lattice (FIG. 4), and a stirrup (FIG. 5) of the kind used to form the elements shown in FIGS. 1-3.

Figure 4:
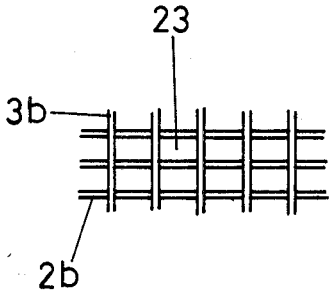
Figure 5:
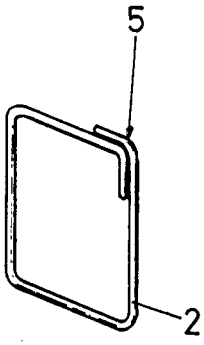
FIG. 5 is a perspective view of a stirrup used in structures such as those shown in FIGS. 1–3.

A metal reinforcement structure is embodied by a number of rods 1 and stirrups 2, 2', 2'' and so on distributed regularly along the structure. In the beam shown in FIG. 2 the rods 1 and stirrups 2 are combined in known manner with strengthening rods 3. In the particular structure shown in FIG. 3 rods 1 and stirrups 2 are combined and the stirrups 2 are very close together with spaces 4 between them. FIG. 4 shows a mattress or lattice embodied by rods 2*b*, 3*b* bounding gaps 23 of varying sizes. FIG. 5 is a perspective view of a stirrup 2 with its closure or overlap zone 5.

It is the object of the invention to tie all the meeting places between rods 1 and stirrups 2, 2', 2'' etc., to tie the strengthening rod 3 to the stirrups 2, to tie the rod 1 to the overlaps 5 and to tie the crossings of the rods 2*b*, 3*b* of matrices or lattices.

Figure 7:
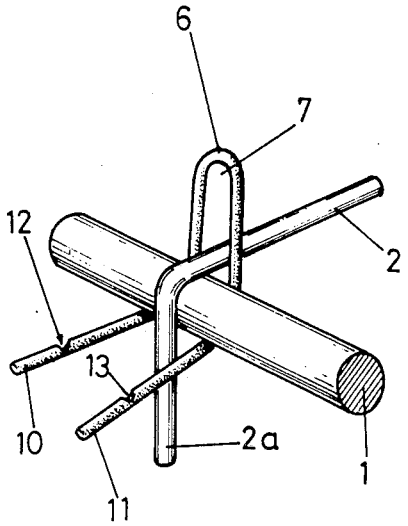
FIG. 7 illustrates the pre-positioning of the clip of FIG. 6 on a corner of the structure shown in FIGS. 1 and 2.
Figure 10:
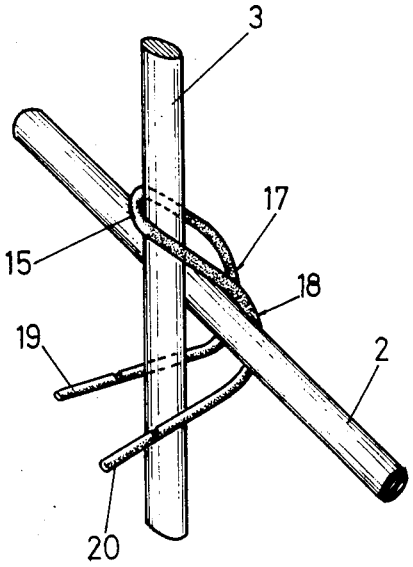
FIG. 10 shows the initial position of a clip of the kind shown in FIG. 8 when the two rods cross one another at right-angles.

The clips are positioned manually or by means of a special container (not shown) in the manner shown in FIGS. 7 and 10, with the particular feature that the clip arm ends always extend towards the outside of the structure.

Figure 6:
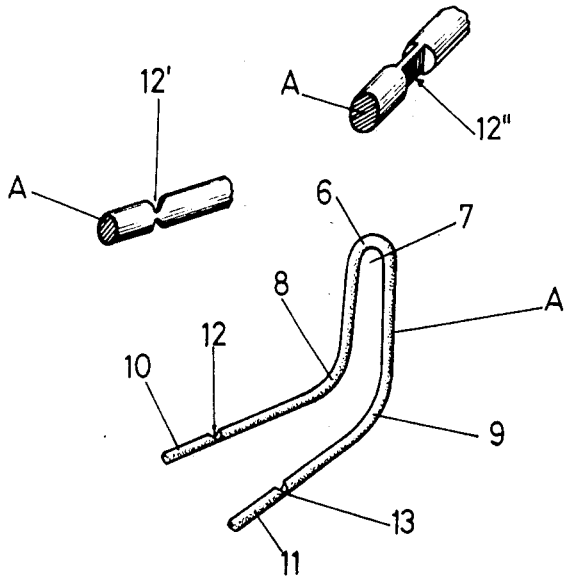
FIG. 6 is a perspective view, with details of a clip used for the invention.

A substantially U-shaped clip A, shown in FIG. 6, has a zone or base 6 bounding a space 7, two bends 8, 9 in its arms, arm ends 10, 11 and optional recesses 12, 13 in the arms 10, 11 which can be devised in any of the forms shown in FIG. 6.

A clip A of the kind described is positioned as shown in FIG. 7 where the gap 7 receives the horizontal portion 2 of the strip, the bends 8, 9 receive the rod 1 and the arms 10, 11 are disposed one on either side of the vertical portion 2*a* of the stirrup, with or without the recesses 12, 13, as previously stated.

Figure 8:
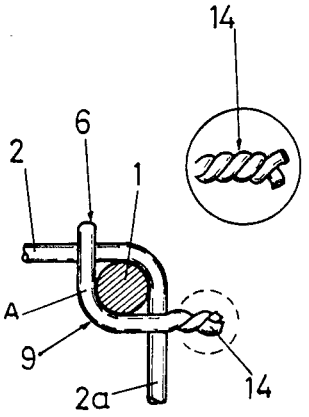
FIG. 8 shows the final shape after twisting.
Figure 9:
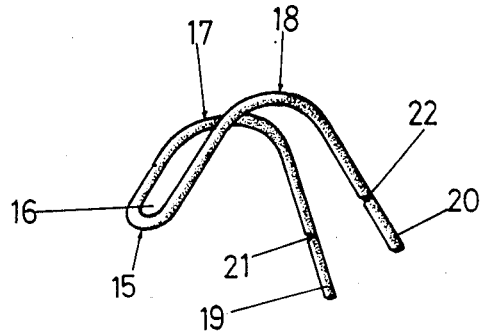
FIG. 9 is a perspective view of another clip used for the invention.

The clip A of FIG. 8 is arranged similarly for the tying of the crossing rods, as also shown in FIG. 9. The clip B is basically similar to the clip A of FIG. 6, the only difference being a greater bending than in that case. By way of its base 15 the clip B receives a rod 3 and by way of its bend 17, 18 the stirrup 2, the free ends 19, 20 being disposed on both sides of the rod 3.

Figure 11:
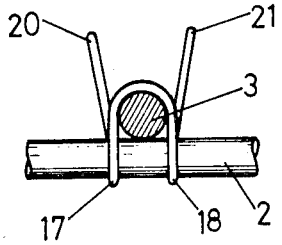
FIG. 11 is a rear view corresponding to FIG. 10.
Figure 12:
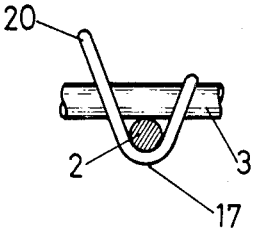
FIG. 12 is a view of the left-hand side of FIG. 11.

The positioning determines the fact that the arms 10, 11 and 19, 20 of the clips A are disposed on the outside of the structure in which they are placed, so that subsequent twisting of such ends is carried out from a single operator position. The twisting step, performed with a tool to be described hereinafter, is performed at the various meeting places in the manner shown in FIG. 8 in the case of the clip A and in the manner shown in FIGS. 11 and 12 in the case of the clip therein.

In FIG. 8, which relates to the clip A, used for crossing rods, one of which is bent, the rod 1 is pressed against the stirrup 2 by the action of twisting the clip ends. The effect of the twisting is that the clip portion 6 presses up against the horizontal zone of the stirrup 2 so that the ends 10, 11 of the clip A (FIGS. 6 and 7) compel the clip portion 6 to engage with the horizontal zone of the stirrup. Another effect of the twisting is that pressure is applied to the stirrup portion 2*a* until the clip ruptures when the elastic limit of the material of which it is made is exceeded. The tensioning of the clip therefore provides a very strong connection between the two rods 2 and 1. The clip A bears on and twists on the same rod 1 simultaneously as it presses by way of the zones 8, 9 on the stirrup 2.

The clip diameter, material etc. which is always the same is used for every structure, so that the clip ends break at the same distance and simultaneously, leaving an equal twist length at every corner of the stirrup 2, the twist always facing outwards, as previously stated.

This is a very important point, for when formwork is subsequently placed around this structure for subsequent concreting, the equal twist lengths which project to the outside will ensure an adequate gap between the formwork and the structure, so that the concrete will cover the entire structure or column evenly without leaving gaps.

The overlapping zones 5 of the stirrup 2 are tied similarly except that the central aperture of the clip A receives two stirrup arms instead of just one, as is obvious.

In the case of a simple crossing of rods as shown in FIG. 10 and in the cases shown in FIGS. 2 and 4, the clip varies very slightly. There is no formal variation and a clip identical to the previous clip can be used. In any case the behaviour is the same, as can be gathered from FIGS. 10-12. The clip B receives in its gap 16 the strengthening or reinforcing rod 3, the bends 17, 18 engage the stirrup 2 and the ends 19, 20 are disposed on either side of the rod 3 ready to be twisted and cut by the tool.

In all cases the free ends of the clips must be subsequently twisted together, then finally cut. For this purpose a tool is used which first engages the clip arms ends, then twists the clip arms against the rods they engage around, then finally breaks the ends engaged originally and leaves the twist with sufficient pressure transmitted.

Figure 19:
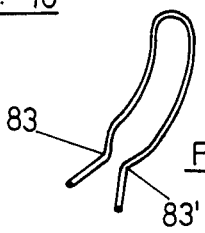
FIG. 19 shows a version of the clip according to the invention which comprises spring-like interruptions.

Referring to FIG. 19, this clip according to the invention is very useful since because of its terminal bends 83 it acts like a spring once placed on the rods and before the tying of its ends, thus being reliably engaged non-releasably in its position.

As previously stated, the process performs the two operations seriatim - i.e., the positioning of a clip and the twisting of the free ends thereof - such ends always being disposed in the same position at each crossing place. The tool is applied to the arms of the clips in this position; the tool comprises at the front a pair of jaws which close around the clip arms, turn to twist the two arms until they break open and automatically reposition themselves in the initial open position ready to receive the arms of the next clip without the operator function varying.

The tool has means for opening and closing the front jaws, means for rotating the same when closed on the clip ends and means restoring the jaws to their original position. All these means are received inside a body of an elongated and substantially cylindrical shape terminating in an end member to whose front exterior the jaws have access.

Figure 13:
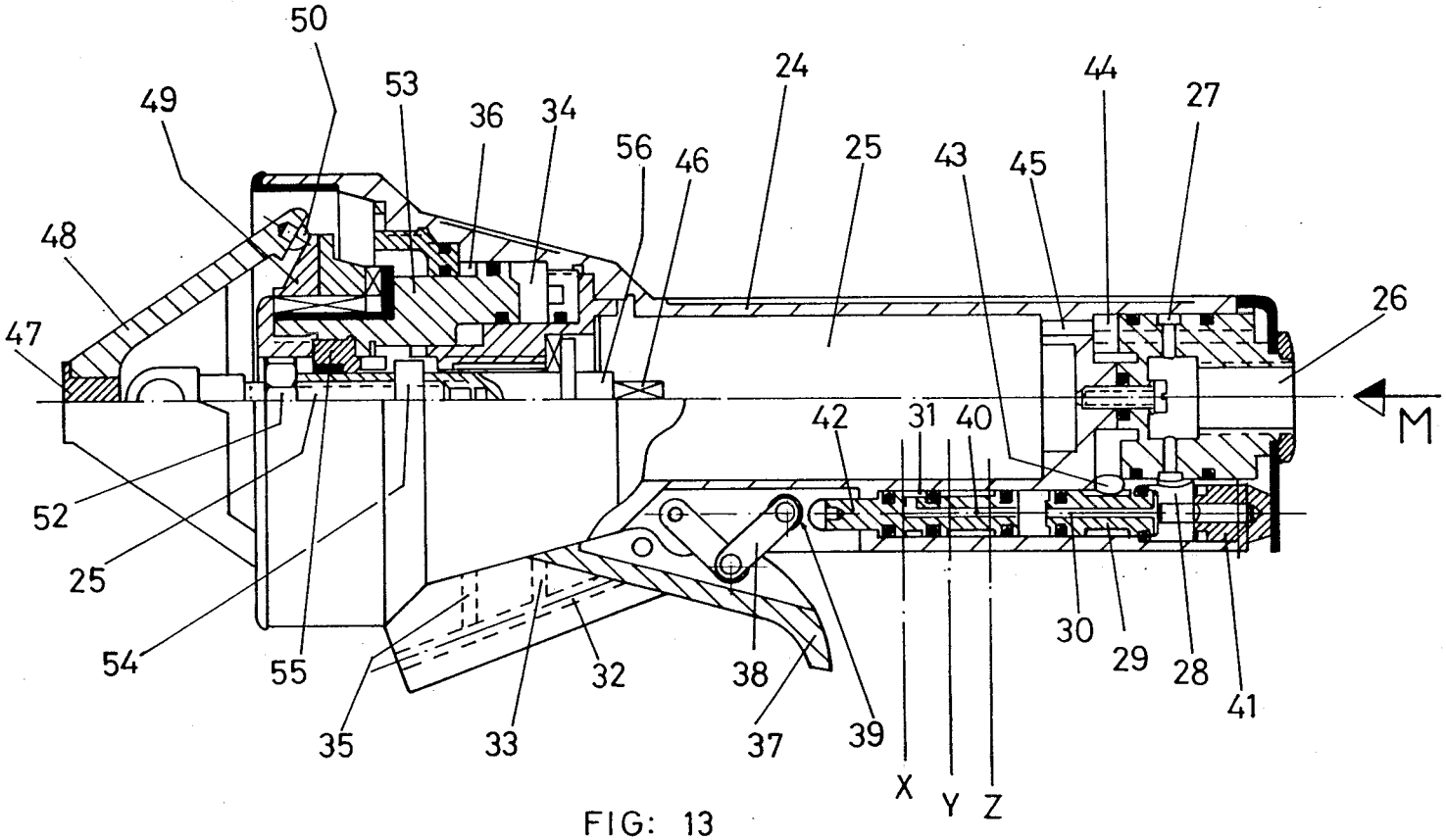
FIG. 13 is a sectioned elevation of a pneumatic version of a tool for tying the clip ends.

The general system of operating the tool can be gathered from FIG. 13, with a general casing 24 and a motor 25 connected to a shaft 56 by connecting part 46.

A piston 53 has a rear head in the chamber, with front and rear inlets 36, 34. The front part of the piston comprises a trunco-conical member 49 on which balls 50 of jaws 48 and mouthpieces 47 bear.

The rear inlet 26 extends in the direction indicated by an arrow M and extends via passage 27 to chamber 28 which compels a sliding member 29 to interrupt the passage to 43. However, the compressed air penetrates via a duct 30, forcing the member 42 forwards. At the same time the air goes through orifice 40 as far as passage 31 and thence to duct 35, through which it goes to the chamber 36, delaying the piston 53 and opening the jaws 48.

When trigger 37 is operated, trigger arm 38 engages by way of a wheel 39 with member 42 and passage 31 changes over to the position indicated by a vertical axis Y to communicate with 33 and, therefore, with chamber 34. Further operation of the trigger 37 leads to contact between the members 42 and 29, the latter being compelled to pass compressed air through 43 to chamber 44 and from 44 through duct 45 to the motor 25, the same rotating. The rotation is transmitted by connecting part 46 to spindle or shaft 56 which rotates the jaws 48 which were applying pressure to the clip tips or ends.

Upon completion of this twisting step and the subsequent rupture of the clip ends, the trigger 37 is released and the system returns to its initial position, taking up its correct angular position etc. because of the combined effect of pin 54 and the mitre 55 which retracts together with the piston 53, the jaws 48 being positioned ready to engage the ends of the next clip, without any variation in operator attitude or tool position.

Figure 14:
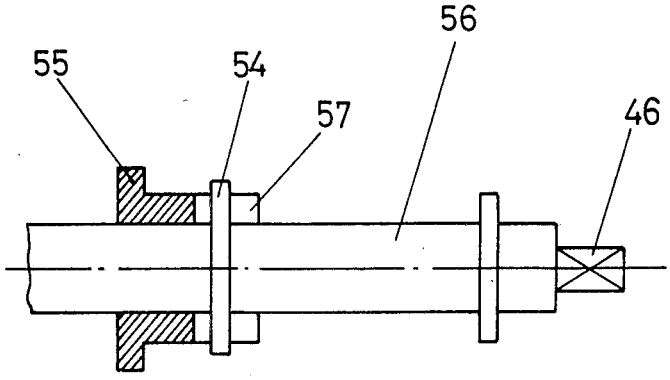
FIG. 14 shows a detail concerning the position between the motor-driven shaft and the pinion "mitre" with reference to FIG. 13.
Figure 15:
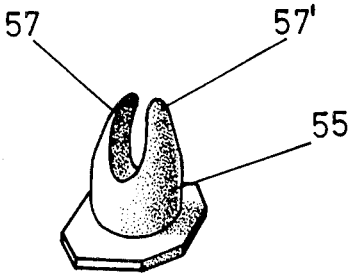
FIG. 15 is a perspective view of the "mitre"
Figure 16:
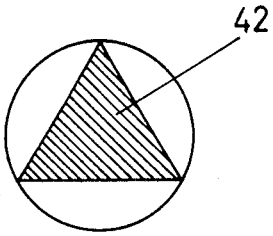
FIG. 16 is a cross-section through the final sliding member actuated by the trigger.

Referring to FIGS. 14–16, spindle 56 comprises a pin 54 and, rigidly secured to the piston, a mitre-shaped member 55 adapted to receive the pin 54 between arms 57 and 57'. When the trigger 37 is released, the piston 53 and the mitre 55 move back and the two tips 57, 57' of the mitre 55 search for the pin 54 and engage it between themselves, so that when the jaws are open they take up a position which is always the same as the initial position relatively to the casing or body of the tool.

Figure 17:
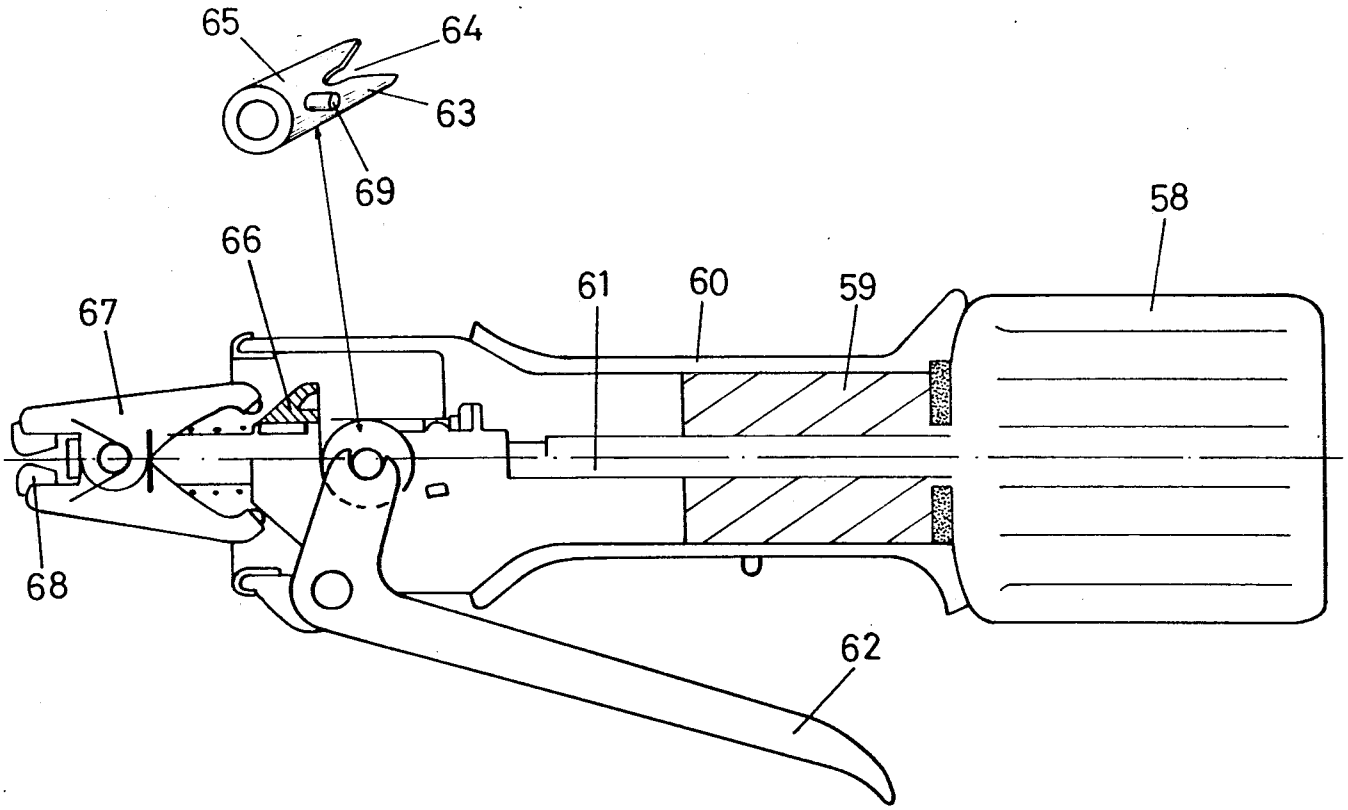
FIG. 17 is an elevation of an electric version of the tool with a detail of the mitre.

FIG. 17 is a diagrammatic view of an electric version of the tool comprising a motor 58, planetary reduction gearing 59 and a shaft 61 all received in a tool casing 60. A lever 62 is adapted to advance or withdraw a connection which transmits the rotation to the jaws 67, 68. In normal conditions and without the lever 62 being operated the jaws 67, 68 are open. When the lever 62 makes a first movement, the jaws close on the clip ends, whereafter the lever is operated again to transmit the rotation to the jaws until the clip ends rupture, whereupon, the lever 62 being released, the rotation is interrupted and the tool returns to its initial position.

As shown in FIG. 17, mitre 65 can be seen with end entrant 64 between a protruberance 63 and lugs 69, as well as the trunco-conical body 66. The mitre 65 denotes the protruberance and the trunco-conical body 66 is mounted on the same with bearings. There is a pin on shaft 61 and the pin is housed within the recess 64 of mitre 65. The lever 62 is connected to the mitre's 65 lugs 69 and when the said lever 62 is actuated, the mitre 65 is brought forward and so is the body 66 which closes the jaws 67 and 68, and at the same time releases the pin from its housing in mitre 65. When the end of the lever 62 - articulated for example - is turned, a switch on the bottom adjacent to lever 62 is contacted and the motor turns and with it the shaft 61 which turns the clamps 67 and 68. Upon releasing the lever 62, a spring takes the assembly back to its initial position.

Figure 18:
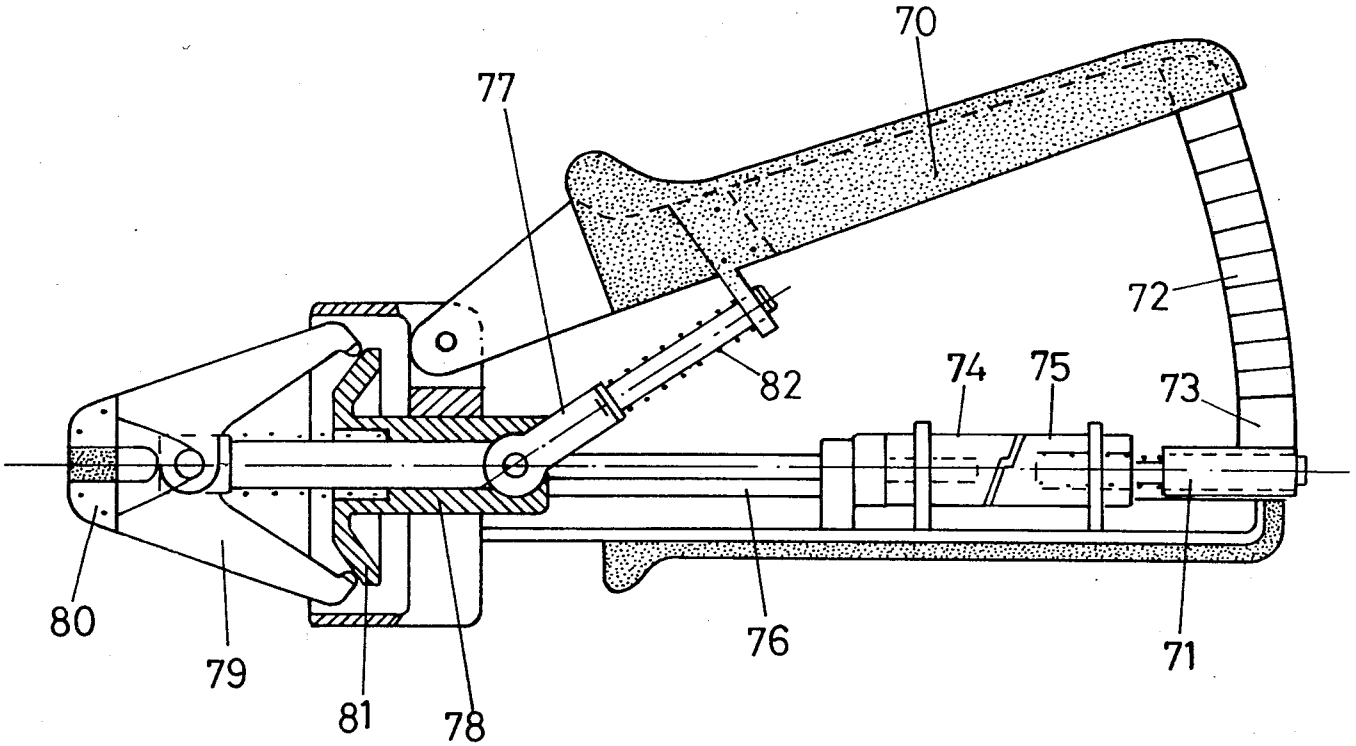
FIG. 18 is an elevation of a manual version of the tool with details of its components.

FIG. 18 shows a manual tool in which the various movements are initiated by means of a lever 70 connected to a forked member 77; when the lever 70 is operated, the member 77 advances a member 81 and closes jaws 79, 80 of the clip ends. The outside end of the lever 70 comprises a member 72 having a circular component and, except in the portion 73, some teeth. Member 72 meshes with a cylindrical tooth member 71 so that when the teeth 72 mesh with 71 the shaft 76 transmits the rotation to the jaws 79, 80.

In the first movement the plain zone 73 of the portion 72 does not rotate the member 71, yet the forked member 70 has advanced the member 81 and the jaws close on the clip. When the teeth 72 mesh with the member 71, the subsequent rotation of the jaws 79, 80 occurs and the clip ends are twisted.

The number of turns which the jaws 79, 80 can perform is infinite, by repeated action on the lever 70. Accordingly, the forked member 77 has a spring which acts continuously on the member 77 to keep the jaws closed on the clip. The lever 70 can therefore be operated as many times as required so that the teeth 72 rotate the shaft 76 when the lever 70 descends, whereas when the clutch 74, 75 between the shaft 76 and the member 71 rises, it does not transmit the rotation of 71 to 76. A clutch 74, 75 of this kind is conventional. As will be apparent, repeated operation of the lever 70 will cause the jaws 79, 80 to make continuous rotations in the same direction until the twist ends break, the jaws 79, 80 remaining closed all the time.

With regard to the characteristics of the clips in general, an uncovered wire having a tensile strength of 46 kg/mm$^2$ was used in the tests and gives very advantageous results. With regard to wire diameters, a diameter of 1.3 mm is found to give the same tying strength as with the conventional manual method when the structures are devised in the same work. The wire diameter of 1.5 mm provides tying stronger than manual tying, while ties made with 1.7 mm diameter wire enable reinforcement structures to withstand any type of long-distance transportation from the place of production without suffering any damage.

The shape of the clips used may vary provided that the general U-shape and the bent arms are retained. For instance, the clips can be formed with notches to improve engagement with the rods, further bends near the free ends of the clip arms, arms of different length and so on, always provided that clip behaviour conforms with this present disclosure.

I claim:

1. A tool for binding of intercrossing elements comprising two front jaws actuable for opening, closing, and turning, having balls attached to back ends of said jaws;

a chamber attached adjacent to said front jaws;

means for opening and closing said front jaws including a piston movable axially inside said chamber, a trunco-conical body movably connected to said piston and positioned to press against said balls to close said jaws;

means for rotating said jaws in their closed position when closed on ends of intercrossing elements; and means for returning said jaws to their initial open position; and means for angularly realigning said jaws in their initial open position.

2. A tool for binding of intercrossing elements comprising two front jaws actuable for opening, closing, and turning, having balls attached to back ends of said jaws;

a chamber attached adjacent to said front jaws;

means for opening and closing said front jaws including a piston movable axially inside said chamber, an axial shaft along which said piston moves;

a trunco-conical body movably connected to said piston and positioned to press against said balls to close said jaws;

means for rotating said jaws in their closed position when closed on ends of intercrossing elements; and means for returning said jaws to their initial open position;

means for angularly realigning said jaws in their initial open position comprising a mitre projection on said piston;

a cross pin crossing said shaft; and a trigger upon release causing said mitre projection to move back from a forward position with a backward movement of said piston.

3. A tool for binding of intercrossing elements comprising two front jaws actuable for opening, closing, and turning, having balls attached to back ends of said jaws;

a chamber attached adjacent to said front jaws;

means for opening and closing said front jaws including a piston movable axially inside said chamber, a trunco-conical body movably connected to said piston and positioned to press against said balls to close said jaws;

means for rotating said jaws in their closed position when closed on ends of intercrossing elements; and means for returning said jaws to their initial open position;

said means for opening and closing said front jaws further including an axial shaft along which said piston moves;

means to supply pressurized air on an alternative basis on front and back sections of said piston;

a lateral hole to receive air from an air supply;

a lower duct to receive air from said lateral hole;

an ancillary duct allowing air to flow through an axial portion to at least part of an extension with an lateral outlet communicating with an internal duct passing air to said front section of said piston;

a trigger which upon pressing causes said lateral outlet to communicate with another internal duct passing air to said back section of said piston;

said means for rotating said jaws further including a motor in said chamber having communication to receive air when said trigger which upon a second pressing closes communication with said front and back sections;

said motor attached to said axial shaft to rotate said shaft and said jaws.

4. A tool according to claim 3 comprising said means for returning said jaws to their initial open position comprising a mitre projection on said piston;

a cross pin crossing said shaft;

said trigger upon release causing said mitre projection to move back from a forward position with a backward movement of said piston.

* * * * *